US005639284A

United States Patent [19]

Ryoke et al.

[11] Patent Number: 5,639,284

[45] Date of Patent: Jun. 17, 1997

[54] ABRASIVE MEMBER

[75] Inventors: Katsumi Ryoke; Tadashi Ishiguro; Masaaki Fujiyama, all of Kanagawa-ken, Japan

[73] Assignee: Fuji Photo Film Co., Ltd., Kanagawa, Japan

[21] Appl. No.: 719,630

[22] Filed: Sep. 25, 1996

[30] Foreign Application Priority Data

Sep. 28, 1995 [JP] Japan ..... 7-250354

[51] Int. Cl.[6] ..... B24D 11/00

[52] U.S. Cl. ..... 51/297; 51/295

[58] Field of Search ..... 51/295, 297, 293; 451/533, 534

[56] References Cited

U.S. PATENT DOCUMENTS

| | | | |
|---|---|---|---|
| 5,108,463 | 4/1992 | Buchanan | 51/295 |
| 5,516,400 | 5/1996 | Pasch et al. | 51/297 |

FOREIGN PATENT DOCUMENTS

| | | | |
|---|---|---|---|
| 62-92205 | 4/1987 | Japan | G11B 5/127 |
| 6-79636 | 3/1994 | Japan | B24D 11/00 |
| 6-179174 | 6/1994 | Japan | B24D 11/00 |

*Primary Examiner*—Deborah Jones

*Attorney, Agent, or Firm*—Sughrue, Mion, Zinn, Macpeak & Seas

[57] ABSTRACT

An abrasive member comprises a non-magnetic substrate and a plurality of abrasive layers, which are overlaid upon the non-magnetic substrate, each of the abrasive layers mainly containing a binder and hard abrasive grains, which have a Mohs hardness of at least 6 and are dispersed in the binder. The plurality of the abrasive layers include a top abrasive layer and a lower abrasive layer, which is formed between the non-magnetic substrate and the top abrasive layer. The thickness of the top abrasive layer is at most A/2, where A represents the thickness of the lower abrasive layer. The mean grain diameter of the abrasive grains contained in the top abrasive layer is at most B/2, where B represents the mean grain diameter of the abrasive grains contained in the lower abrasive layer.

4 Claims, 1 Drawing Sheet

ABRASIVE MEMBER

BACKGROUND OF THE INVENTION

1. Field of the Invention

This invention relates to an abrasive member comprising a non-magnetic substrate and a plurality of abrasive layers, which are overlaid upon the non-magnetic substrate and each of which mainly contains a binder and abrasive grains dispersed in the binder. The abrasive member may take on the form of an abrasive tape, an abrasive disk, or the like, and is used in abrasive processing of materials to be abraded, such as magnetic heads for video tape recorders, audio decks, or magnetic recording and reproducing apparatuses.

2. Description of the Prior Art

As for materials to be abraded, such as magnetic heads, their surfaces are abraded by abrasive members, such as abrasive tapes and abrasive disks, for the purposes of planishing, shape adjustment, or protrusion removal.

Ordinarily, during the process for producing a desired material, the abrasive processing is carried out, in which a predetermined portion of the material is abraded by an abrasive member and is thereby imparted with a desired surface smoothness. However, it often occurs that unexpected, abnormal abrasion scratches occur with the abraded material. In such cases, the problems occur in that the quality of the product cannot be kept good due to the occurrence of scratches.

The abrasive member of this type comprises a substrate and an abrasive layer, which is overlaid upon the substrate and comprises a binder and abrasive grains dispersed in the binder. The abrasive member has abrasion characteristics defined by various factors, such as grain diameter of the abrasive grains, surface roughness of the abrasive layer, and the kind of the binder.

It is required for the abrasive member to satisfy two requirements with respect to the abrasion characteristics in that the grinding power should be high and in that the surface smoothness of the abraded material should be good. However, the two requirements are incompatible with each other. Specifically, as for the conventional abrasive member provided with a single abrasive layer, the grain size of the abrasive grains contained in the abrasive layer is related to the abrasive power and the occurrence of scratches on the surface of the abraded material. For example, if abrasive grains having a large grain size are contained in the abrasive layer, a high abrasive power can be obtained, but more scratches will occur on the surface of the abraded material. If abrasive grains having a small grain size are contained in the abrasive layer, scratches will not readily occur on the surface of the abraded material, but the abrasive power will become low.

An abrasive member comprising a plurality of abrasive layers, which have different characteristics and are overlaid one upon another, is disclosed in, for example, Japanese Unexamined Patent Publication Nos. 6(1994)-79636 and 6(1994)-179174. In the disclosed abrasive member, an abrasive layer containing the abrasive grains having a large grain diameter is formed as the top layer, and an abrasive layer containing the abrasive grains having a small grain diameter is formed as a lower layer. A high abrasive power is obtained with the abrasive grains, which have the large grain size and are contained in the top layer. Also, cushioning characteristics are obtained with the lower abrasive layer, and the occurrence of scratches on the surface of the abraded material is thereby reduced.

Further, an abrasive tape comprising an abrasive layer, which contains the abrasive grains having a small grain diameter and constitutes a top layer, and an intermediate layer, which contains the abrasive grains having a large grain diameter and constitutes a lower layer, is disclosed in, for example, Japanese Unexamined Patent Publication No. 62(1987)-92205. In the disclosed abrasive tape, the abrasive grains, which have a large grain diameter and are contained in the intermediate layer, are constituted of soft non-magnetic grains having a Mohs hardness of approximately 1, such as talc powder.

As described above, with the abrasive member comprising the abrasive layer, which contains the abrasive grains having a large grain diameter and constitutes the top layer, and the abrasive layer, which contains the abrasive grains having a small grain diameter and constitutes the lower layer, a high abrasive power can be obtained. However, the abrasive member has the problems in that sufficient effects of restricting the occurrence of scratches cannot be obtained with the lower layer, and scratches occur to a certain extent on the surface of the abraded material.

Also, with the abrasive tape comprising the abrasive layer, which contains the abrasive grains having a small grain diameter and constitutes the top layer, and the intermediate layer, which contains the abrasive grains having a low hardness and a large grain diameter and constitutes the lower layer, the problems occur in that a desired surface roughness of the top abrasive layer cannot be obtained, and therefore a high abrasive power cannot be obtained.

SUMMARY OF THE INVENTION

The primary object of the present invention is to provide an abrasive member, in which the surface smoothness of an abraded material is obtained with an abrasive layer containing abrasive grains having a small grain diameter, and which has a markedly enhanced abrasive power.

Another object of the present invention is to provide an abrasive member, which has a markedly enhanced abrasive power and causes no large scratches to occur on the surface of the abraded material.

The present invention provides an abrasive member comprising a non-magnetic substrate and a plurality of abrasive layers, which are overlaid upon the non-magnetic substrate, each of the abrasive layers mainly containing a binder and hard abrasive grains, which have a Mohs hardness of at least 6 and are dispersed in the binder, wherein the plurality of the abrasive layers include a top abrasive layer and a lower abrasive layer, which is formed between the non-magnetic substrate and the top abrasive layer, the thickness of the top abrasive layer is at most A/2, where A represents the thickness of the lower abrasive layer, and the mean grain diameter of the abrasive grains contained in the top abrasive layer is at most B/2, where B represents the mean grain diameter of the abrasive grains contained in the lower abrasive layer.

In the abrasive member in accordance with the present invention, the thickness A of the lower abrasive layer should preferably fall within the range of 10 μm to 100 μm, and the mean grain diameter B of the abrasive grains contained in the lower abrasive layer should preferably fall within the range of 5 μm to 100 μm. Also, the abrasive grains contained in the top abrasive layer should preferably be constituted of at least a single kind of abrasive grains selected from the group consisting of alumina, chromium oxide, silicon carbide, and diamond. Further, the abrasive grains contained in the lower abrasive layer should preferably be constituted of alumina.

With the constitution of the abrasive member in accordance with the present invention, the grain diameter of the abrasive grains contained in the lower abrasive layer is large, and therefore the surface of the lower abrasive layer has an uneven shape with large undulations. The thickness of the top abrasive layer is small, and the. surface of the top abrasive layer has an uneven shape, that reflects the uneven shape of the lower abrasive layer. However, the grain diameter of the abrasive grains contained in the top abrasive layer is small, and therefore the surface roughness of small areas of the entire surface of the top abrasive layer is small.

With the abrasive member in accordance with the present invention, the lower abrasive layer and the top abrasive layer, each of which mainly contains the binder and the hard abrasive grains having a Mohs hardness of at least 6, are overlaid upon the non-magnetic substrate. The thickness of the top abrasive layer is at most one-half of the thickness of the lower abrasive layer. Also, the mean grain diameter of the abrasive grains contained in the top abrasive layer is at most one-half of the mean grain diameter of the abrasive grains contained in the lower abrasive layer. Therefore, the large undulations of the surface of the top abrasive layer can be formed by the coarse abrasive grains contained in the lower abrasive layer. Also, with the large undulations of the top abrasive layer, a high abrasive power can be obtained which will be obtained if the abrasive grains having a large grain diameter are contained in the top abrasive layer. Further, with the abrasive member in accordance with the present invention, wherein the abrasive grains having a small grain diameter are contained in the top abrasive layer, large scratches do not occur on the surface of the abraded material, and good surface smoothness of the abraded material can be obtained.

In particular, the abrasive grains contained in the lower abrasive layer are constituted of hard grains having a Mohs hardness of at least 6. Therefore, the shape of the surface of the lower abrasive layer can be formed in a predetermined uneven shape, and the uneven shape of the top abrasive layer can be kept in a desired state. Accordingly, the enhancement of the abrasive power and the prevention of the occurrence of large scratches on the surface of the abraded material can be achieved reliably.

The present invention will hereinbelow be described in further detail with reference to the accompanying drawing.

DETAILED DESCRIPTION OF THE INVENTION

Figure 1:
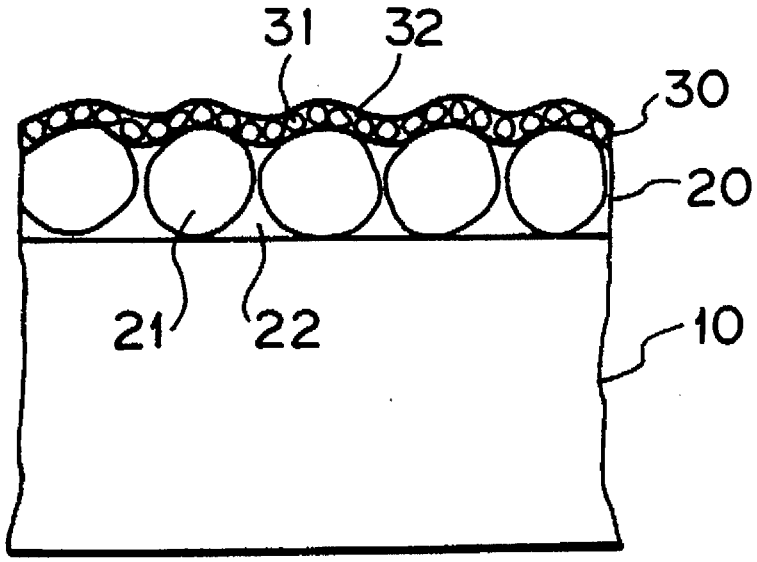
FIG. 1 is a schematic view showing an embodiment of the abrasive member in accordance with the present invention.

FIG. 1 schematically shows an embodiment of the abrasive member in accordance with the present invention. With reference to FIG. 1, the abrasive member, which may take on the form of an abrasive tape, comprises a non-magnetic substrate 10, a lower abrasive layer 20 overlaid upon the non-magnetic substrate 10, and a top abrasive layer 30 overlaid upon the lower abrasive layer 20. The lower abrasive layer 20 mainly contains a binder 22 and hard abrasive grains 21, which have a Mohs hardness of at least 6 and are dispersed in the binder 22. Also, the top abrasive layer 30 mainly contains a binder 32 and hard abrasive grains 31, which have a Mohs hardness of at least 6 and are dispersed in the binder 32.

The thickness A of the lower abrasive layer 20, the mean grain diameter B of the abrasive grains 21 contained in the lower abrasive layer 20 , the thickness C of the top abrasive layer 30, and the mean grain diameter D of the abrasive grains 31 contained in the top abrasive layer 30 satisfy the conditions shown below.

$$A=B \text{ to } 5B,\ C=D \text{ to } 5D,$$

$$C \leqq A/2,\ D \leqq B/2$$

As the abrasive grains, which are contained in the lower abrasive layer and the top abrasive layer, ordinarily, the materials having the abrasive effects or scratch polishing effects are used. Examples of the materials for the abrasive grains include α-alumina, γ-alumina, α·γ-alumina, fused alumina, silicon carbide, chromium oxide, cerium oxide, corundum, artificial diamond, diamond, α-iron oxide, garnet, emery (major constituents: corundum and magnetite), silica, silicon nitride, boron nitride, molybdenum carbide, boron carbide, tungsten carbide, titanium carbide, tripoli, diatomaceous earth, and dolomite. Principally, one of the above-enumerated abrasive grain materials having a Mohs hardness of at least 6 may be used alone, or two to four materials having a Mohs hardness of at least 6 may be used in combination. Examples of the abrasive grains include AKP1, AKP15, AKP20, AKP30, AKP50, AKP80, Hit50, and Hit100, which are supplied by Sumitomo Chemical Co., Ltd. Such abrasive grains are described in, for example, Japanese Patent Publication Nos. 52(1977)-28642 and 49(1974)-39402, Japanese Unexamined Patent Publication No. 63(1988)-98828, U.S. Pat. Nos. 3,687,725, 3,007,807, 3,041,196, 3,293,066, 3,630,010, 3,833,412, and 4,117,190, British Patent No. 1,145,349, and West Germany Patent No. 853,211.

In particular, the abrasive grains contained in the top abrasive layer should preferably be constituted of at least a single kind of abrasive grains selected from the group consisting of alumina, chromium oxide, silicon carbide, and diamond. Also, the abrasive grains contained in the lower abrasive layer should preferably be constituted of alumina. As the abrasive grains contained in the lower abrasive layer, the abrasive grains having a mean grain size falling within the range of 5 μm to 100 μm should preferably be used, and the abrasive grains having a mean grain size falling within the range of 8 μm to 80 μm should more preferably be used. Further, as the abrasive grains contained in the top abrasive layer, the abrasive grains having a mean grain size falling within the range of 0.1 μm to 10 μm should preferably be used, and the abrasive grains having a mean grain size falling within the range of 0.2 μm to 6 μm should more preferably be used.

As the binders contained in the abrasive layers of the abrasive member in accordance with the present invention, any of binders known in the art may be used. Examples of these binders include thermoplastic resins, thermosetting resins, reactive resins, electron beam-curing resins, ultraviolet-curing resins, visible light-curing resins, and mixtures of two or more of these resins.

The thermoplastic resins, which may be used as the binders in the abrasive layers of the abrasive member in accordance with the present invention, generally have a softening point of 150° C. or lower, an average molecular weight falling within the range of approximately 10,000 to approximately 300,000, and a polymerization degree falling within the range of approximately 50 to approximately 2,000. The polymerization degrees of the thermoplastic resins should preferably fall within the range of approximately 200 to approximately 600. Specifically, as the thermoplastic resin, it is possible to use, for example, a vinyl chloride-vinyl acetate copolymer, a vinyl chloride copolymer, a vinyl chloride-vinyl acetate-vinyl alcohol copolymer, a vinyl chloride-vinyl alcohol copolymer, a vinyl chloride-vinylidene chloride copolymer, a vinyl chloride-acrylonitrile copolymer, an acrylic ester-acrylonitrile copolymer, an acrylic ester-vinylidene chloride copolymer, an acrylic ester-styrene copolymer, a methacrylic ester-acrylonitrile copolymer, a methacrylic ester-vinylidene chloride copolymer, a methacrylic ester-styrene copolymer, a urethane elastomer, a nylon-silicone resin, a nitrocellulose-polyamide resin, polyvinyl fluoride resin, a vinylidene chloride-acrylonitrile copolymer, a butadiene-acrylonitrile copolymer, a polyamide resin, a polyvinyl butyral resin, a cellulose derivative (such as cellulose acetate butyrate, cellulose diacetate, cellulose triacetate, cellulose propionate, nitrocellulose, ethyl cellulose, methyl cellulose, propyl cellulose, methyl ethyl cellulose, carboxymethyl cellulose, or acetyl cellulose), a styrene-butadiene copolymer, a polyester resin, a polycarbonate resin, a chlorovinyl ether-acrylic ester copolymer, an amino resin, a synthetic rubber type thermoplastic resin, or a mixture of two or more of these compounds. Such resins are described in, for example, Japanese Patent Publication Nos. 37(1962)-6877, 39(1964)-12528, 39(1964)-19282, 40(1965)-5349, 40(1965)-20907, 41(1966)-9463, 41(1966)-14059, 41(1966)-16985, 42(1967)-6428, 42(1967)-11621, 43(1968)-4623, 43(1968)-15206, 44(1969)-2889, 44(1969)-17947, 44(1969)-18232, 45(1970)-14020, 45(1970)-14500, 47(1972)-18573, 47(1972)-22063, 47(1972)-22064, 47(1972)-22068, 47(1972)-22069, 47(1972)-22070, and 47(1972)-27886, Japanese Unexamined Pat. Publication Nos. 57(1982)-133521, 58(1983)-137133, 58(1983)-166533, 58(1983)-222433, and 59(1984)-58642, and U.S. Pat. Nos. 4,571,364 and 4,752,530.

As the thermosetting resins or the reactive resins, which may be used as the binders in the abrasive layers of the abrasive member in accordance with the present invention, there should preferably be employed the resins, which have a molecular weight of 200,000 or less when the resins take on the form of coating compositions, and which exhibit an infinite increase in the molecular weight through the condensation reactions, the addition reactions, or the like, when the coating compositions are heated and humidified after being applied onto substrates and dried. Among these resins, the resins, which do not soften or melt before they decompose thermally, should more preferably be employed. Specifically, examples of the thermosetting resins or the reactive resins include a phenol resin, a phenoxy resin, an epoxy resin, a polyurethane resin, a polyester resin, a polyurethane polycarbonate resin, a urea resin, a melamine resin, an alkyd resin, a silicone resin, an acrylic reactive resin (an electron beam-curing resin), an epoxy-polyamide resin, a nitrocellulose melamine resin, a mixture of a high-molecular weight polyester resin with an isocyanate prepolymer, a mixture of a methacrylate copolymer with a diisocyanate prepolymer, a mixture of a polyester polyol with a polyisocyanate, a urea-formaldehyde resin, a mixture of a low-molecular weight glycol, a high-molecular weight diol and a triphenylmethane triisocyanate, a polyamine resin, a polyimine resin, and a mixture of two or more of these compounds. Such resins are described in, for example, Japanese Patent Publication Nos. 39(1964)-8103, 40(1965)-9779, 41(1966)-7192, 41(1966)-8016, 41(1966)-14275, 42(1967)-18179, 43(1968)-12081, 44 (1969)-28023, 45(1970)-14501, 45(1970)-24902, 46(1971)-13103, 47(1972)-22065, 47(1972)-22066, 47(1972)-22067, 47(1972)-22072, 47(1972)-22073, 47(1972)-28045, 47(1972)-28048, and 47(1972)-28922.

In general, the thermoplastic resins, the thermosetting resins, and the reactive resins described above respectively have their major functional groups, and one to six kinds of other functional groups. Each of the other functional groups should preferably be contained in proportions within the range of $1\times10^{-6}$ equivalent to $1\times10^{-2}$ equivalent per gram of the resin. Examples of the other functional groups include acid groups, such as a carboxylic acid group (COOM), a sulfinic acid group, a sulfenic acid group, a sulfonic acid group ($SO_3M$), a phosphoric acid group [PO(OM)(OM)], a phosphonic acid group, a sulfuric acid group ($OSO_3M$), and ester groups with these acids, wherein M represents H, an alkali metal, an alkaline earth metal, or a hydrocarbon group; groups of amphoteric compounds, such as a group of an amino acid, a group of an aminosulfonic acid, a group of a sulfuric ester of amino-alcohol, a group of a phosphoric ester of amino-alcohol, and an alkyl betaine form group; basic groups, such as an amino group, an imino group, an imido group, and an amido group; a hydroxyl group; an alkoxyl group; a thiol group; an alkylthio group; halogen groups, such as F, Cl, Br, and I; a silyl group; a siloxane group; an epoxy group; an isocyanato group; a cyano group; a nitrile group; an oxo group; an acryl group; and a phosphine group.

In the abrasive member in accordance with the present invention, the above-enumerated binders are used alone, or two or more of them are used in combination. Also, the other additives are added to the abrasive layers, when necessary. The binder is contained in each abrasive layer in a proportion falling within the range of 5 to 300 parts by weight per 100 parts by weight of the abrasive grains. In cases where the abrasive member is provided with a backing layer, the binder may be contained in the backing layer in a proportion falling within the range of 8 to 400 parts by weight per 100 parts by weight of the fine grains. Examples of the additives include a dispersing agent, a lubricating agent, abrasive grains, an antistatic agent, an antioxidant, a mildew-proofing agent, and a solvent.

In the abrasive layers of the abrasive member in accordance with the present invention, polyisocyanates may be contained. As the polyisocyanates, it is possible to use, for example, isocyanates, such as tolylene diisocyanate, 4,4'-diphenylmethane diisocyanate, hexamethylene diisocyanate, xylylene diisocyanate, naphthylene-1,5-diisocyanate, o-toluidine diisocyanate, isophorone diisocyanate, and triphenylmethane triisocyanate. As the polyisocyanates, it is also possible to use products of reactions between the above-enumerated isocyanates and polyalcohols, and dimer to decamer polyisocyanates produced from condensation of isocyanates, and products which are obtained from reactions between polyisocyanates and polyurethanes and which have isocyanate groups as terminal functional groups.

The polyisocyanates enumerated above should preferably have an average molecular weight falling within the range of 100 to 20,000. Such polyisocyanates are commercially available as, for example, Coronate L, Coronate HL, Coronate 2030, Coronate 2031, Myrionate MR, and Myrionate MTL (supplied by Nippon Polyurethane K.K.); Takenate D-102, Takenate D-110N, Takenate D-200, Takenate D-202, Takenate 300S, and Takenate 500 (supplied by Takeda Chemical Industries, Ltd.); Sumidur T-80, Sumidur 44S, Sumidur PF, Sumidur L, Sumidur N, Desmodur L, Desmodur IL, Desmodur N, Desmodur HL, Desmodur T65, Desmodur 15, Desmodur R, Desmodur RF, Desmodur SL, and Desmodur Z4273 (supplied by Sumitomo Bayer K.K.). These polyisocyanates may be used alone, or a mixture of two or more of them may be used by the utilization of differences in curing reaction properties. Also, in order to promote the curing reaction, compounds having a hydroxyl group (such as butanediol, hexanediol, polyurethane having a molecular weight within the range of 1,000 to 10,000, and water), compounds having an amino group (such as monomethylamine, dimethylamine, and trimethylamine), catalysts, such as metal oxides and iron acetylacetonate, may be used together with the polyisocyanates. The compounds having a hydroxyl group or an amino group should preferably be polyfunctional. The proportions of the polyisocyanate used in each of the abrasive layers and the backing layer should preferably fall within the range of 2 to 70 parts by weight per 100 parts by weight of the total of the binder and the polyisocyanate, and should more preferably fall within the range of 5 to 50 parts by weight per 100 parts by weight of the total of the binder and the polyisocyanate. Such polyisocyanates are described in, for example, Japanese Unexamined Patent Publication Nos. 60(1985)-131622 and 61(1986)-74138.

Examples of the powdered lubricating agents, which may be employed in the abrasive layers of the abrasive member in accordance with the present invention, include fine grains of inorganic materials, such as graphite, molybdenum disulfide, boron nitride, graphite fluoride, calcium carbonate, barium sulfate, silicon oxide, titanium oxide, zinc oxide, tin oxide, and tungsten disulfide; and fine grains of resins, such as an acryl-styrene resin, a benzoguanamine resin, a melamine resin, a polyolefin resin, a polyester resin, a polyamide resin, a polyimide resin, and a polyfluoroethylene resin.

As the lubricating agents, various organic compounds may also be employed. Examples of such organic compounds include compounds into which fluorine or silicon is introduced, such as a silicone oil (e.g., a dialkyl polysiloxane, a dialkoxy polysiloxane, a phenyl polysiloxane, or a fluoroalkyl polysiloxane, which is supplied as KF96, KF69, or the like, by Shin-Etsu Chemical Co., Ltd.), a fatty acid-modified silicone oil, a fluorine alcohol, a polyolefin (e.g., a polyethylene wax or a polypropylene), a polyglycol (e.g., ethylene glycol or a polyethylene oxide wax), a tetrafluoroethylene oxide wax, a polytetrafluoroglycol, a perfluoroalkyl ether, a perfluorofatty acid, a perfluorofatty acid ester, a perfluoroalkylsulfuric ester, a perfluoroalkylsulfonic ester, a perfluoroalkylbenzenesulfonic ester, and a perfluoroalkylphosphoric ester; organic acids and organic acid ester compounds, such as an alkylsulfuric ester, an alkylsulfonic ester, an alkylphosphonic triester, an alkylphosphonic monoester, an alkylphosphonic diester, an alkylphosphoric ester, and a succinic ester; heterocyclic compounds containing nitrogen or sulfur, such as triazaindolizine, tetraazaindene, benzotriazole, benzotriazine, benzodiazole, and EDTA; a fatty acid ester of a monobasic fatty acid having 10 to 40 carbon atoms with one or at least two of a monohydric alcohol, a dihydric alcohol, a trihydric alcohol, a tetrahydric alcohol and a hexahydric alcohol, each alcohol having 2 to 40 carbon atoms; a fatty acid ester of a monobasic fatty acid having at least 10 carbon atoms with such an monohydric, dihydric, trihydric, tetrahydric, pentahydric or hexahydric alcohol that the sum of the number of the carbon atoms of the fatty acid and the number of the carbon atoms of the alcohol may fall within the range of 11 to 70; and fatty acids, fatty acid amides, fatty acid alkyl amides, and aliphatic alcohols, which have 8 to 40 carbon atoms. Examples of these organic compound lubricating agents include butyl caprylate, octyl caprylate, ethyl laurate, butyl laurate, octyl laurate, ethyl myristate, octyl myristate, 2-ethylhexyl myristate, ethyl palmitate, butyl palmitate, octyl palmitate, 2-ethylhexyl palmitate, ethyl stearate, butyl stearate, isobutyl stearate, octyl stearate, 2-ethylhexyl stearate, amyl stearate, isoamyl stearate, 2-ethylpentyl stearate, 2-hexyldecyl stearate, isotridecyl stearate, stearic acid amide, stearic acid alkyl amide, butoxyethyl stearate, anhydrosorbitan monostearate, anhydrosorbitan distearate, anhydrosorbitan tristearate, anhydrosorbitan tetrastearate, oleyl oleate, oleyl alcohol, lauryl alcohol, montan wax, and carnauba wax. The above-enumerated compounds may be used alone, or two or more of them may be used in combination.

Further, in the abrasive member in accordance with the present invention, the so-called lubricating oil additives may be used as the lubricating agents. The lubricating oil additives may be used alone, or two or more of them may be used in combination. Examples of such lubricating oil additives include antioxidants known as anticorrosive agents (e.g., metal chelating agents, such as an alkyl phenol, benzotriazine, tetraazaindene, sulfamide, guanidine, nucleic acid, pyridine, amine, hydroquinone, and EDTA), rust preventives (e.g., naphthenic acid, alkenylsuccinic acid, and dilauryl phosphate), oiliness improvers (e.g., colza oil and lauryl alcohol), extreme pressure additives (e.g., dibenzyl sulfide, tricresyl phosphate, and tributyl phosphite), detergent-dispersants, viscosity index improvers, pour point depressants, and foaming preventives. These lubricating agents are added in proportions falling within the range of 0.01 to 30 parts by weight per 100 parts by weight of the binder. Such compounds are described in, for example, Japanese Patent Publication Nos. 43(1968)-23889, 48(1973)-24041, 48(1973)-18482, 44(1969)-18221, 47(1972)-28043, and 57(1982)-56132, Japanese Unexamined Patent Publication Nos. 59(1984)-8136, 59(1984)-8139, and 61(1986)-85621, and U.S. Pat. Nos. 3,423,233, 3,470,021, 3,492,235, 3,497,411, 3,523,086, 3,625,760, 3,630,772, 3,634,253, 3,642,539, 3,687,725, 4,135,031, 4,497,864, and 4,552,794. Examples of the compounds are also described in "IBM Technical Disclosure Bulletin," Vol. 9, No. 7, p. 779 (December 1966); "ELEKTRONIK", 1961, No. 12, p. 380; and "Kagaku Benran" (Chemical Handbook), application edition, pp. 954–967, 1980, Maruzen.

Further, in the present invention, as the dispersing agents and dispersion assisting auxiliaries, it is possible to employ fatty acids having 2 to 40 carbon atoms ($R_1COOH$, wherein $R_1$ represents an alkyl group, a phenyl group, or an aralkyl group, which has 1 to 39 carbon atoms), such as caprylic acid, capric acid, lauric acid, myristic acid, palmitic acid, stearic acid, oleic acid, elaidic acid, linoleic acid, linolenic acid, stearolic acid, behenic acid, maleic acid, and phthalic acid; salts of the above-enumerated fatty acids with alkali metals (Li, Na, K, and the like) or alkaline earth metals (Mg, Ca, Ba, and the like); metallic soaps comprising Cu, Pb, and the like, (e.g., copper oleate); fatty acid amides; and lecithins (e.g., soybean oil lecithin). As the dispersing agents and dispersion assisting auxiliaries, it is also possible to employ higher alcohols having 4 to 40 carbon atoms (e.g., butyl alcohol, octyl alcohol, myristyl alcohol, and stearyl alcohol), sulfuric esters of these higher alcohols, sulfonic acid, phenylsulfonic acids, alkylsulfonic acids, sulfonic esters, phosphoric monoesters, phosphoric diesters, phosphoric triesters, alkylphosphonic acids, phenylphosphonic acids, and amine compounds. As the dispersing agents and dispersion assisting auxiliaries, it is further possible to employ polyethylene glycols, polyethylene oxides, sulfosuccinic acid, sulfosuccinic acid metal salts, and sulfosuccinic esters. Ordinarily, one or more kinds of the dispersing agents are employed. One kind of the dispersing agent is added in proportions falling within the range of 0.005 to 20 parts by weight per 100 parts by weight of the binder. When the dispersing agent is used, it may be adhered to the surfaces of the abrasive grains or fine non-abrasive grains, or may be added during the dispersion process. Such dispersing agents and dispersion assisting auxiliaries are described in, for example, Japanese Patent Publication Nos. 39(1964)-28369, 44(1969)-17945, 44(1969)-18221, 48(1973)-7441, 48(1973)-15001, 48(1973)-15002, 48(1973)-16363, and 49(1974)-39402, and U.S. Pat. Nos. 3,387,993 and 3,470,021.

Examples of the mildew-proofing agents, which may be employed in the abrasive member in accordance with the present invention, include 2-(4-thiazolyl)-benzimidazole, N-(fluorodichloromethylthio)-phthalimide, 10,10'-oxybisphenoxarsine, 2,4,5,6-tetrachloroisophthalonitrile, p-tolyldiiodomethylsulfone, triiodoallyl alcohol, dihydroacetonic acid, mercury phenyloleate, bis(tributyltin) oxide, and salicylanilide. Such compounds are described in, for example, "Microbial Calamity and Preventing Technique," published by Kogaku Tosho, 1972; and "Chemistry and Industry," Vol. 32, p. 904, 1979.

As the antistatic agents, carbon black, and the like, may be employed in the abrasive member in accordance with the present invention. Examples of the antistatic agents other than carbon black include conductive grains, such as grains of graphite, modified graphite, carbon black graft polymer, tin oxide-antimony oxide, tin oxide, and titanium oxide-tin oxide-antimony oxide; natural surface active agents, such as saponin; nonionic surface active agents, such as an alkyleneoxide compound, a glycerin compound, a glycidol compound, a polyhydric alcohol, a polyhydric alcohol ester, and an adduct of an alkyl phenol with ethylene oxide; cationic surface active agents, such as a higher alkylamine, a cyclic amine, a hydantoin derivative, an amidoamine, an ester amide, a quaternary ammonium salt, a heterocyclic compound, e.g. pyridine, a phosphonium compound, and a sulfonium compound; anionic surface active agents containing acidic groups, such as a carboxylic acid group, a sulfonic acid group, a phosphonic acid group, a phosphoric acid group, a sulfuric ester group, a phosphonic ester group, and a phosphoric ester group; and amphoteric surface active agents, such as an amino acid, an amino sulfonic acid, a sulfate or a phosphate of an amino alcohol, and an alkyl betaine compound.

Several examples of the surface active agents, which may be employed as the antistatic agents, are described in, for example, Japanese Unexamined Patent Publication No. 60(1985)-28025, U.S. Pat. Nos. 2,271,623, 2,240,472, 2,288,226, 2,676,122, 2,676,924, 2,676,975, 2,691,566, 2,727,860, 2,730,498, 2,742,379, 2,739,891, 3,068,101, 3,158,484, 3,201,253, 3,210,191, 3,294,540, 3,415,649, 3,441,413, 3,442,654, 3,475,174, and 3,545,974, West Germany Offenlegungsschrift (OLS) No. 1,942,665, and British Patent Nos. 1,077,317 and 1,198,450. Examples of the surface active agents are also described in "Synthesis and Applications of Surface Active Agents" by Ryohei Oda, et al., Tsubaki Shoten, 1972; "Surface Active Agents" by A. W. Bailey, Interscience Publication Incorporated, 1958; "Encyclopedia of Surface Active Agents, Vol. 2" by T. P. Sisley, Chemical Publish Company, 1964; "Surface Active Agent Handbook", sixth edition, Sangyo Tosho K.K., Dec. 20, 1966; and "Antistatic Agents" by Hideo Marushige, Saiwai Shobo, 1968.

The surface active agents may be used alone, or two or more of them may be used in combination. The proportions of the surface active agent in the abrasive layers should preferably fall within the range of 0.01 to 10 parts by weight per 100 parts by weight of the abrasive grains. In cases where the surface active agent is employed in the backing layer, it may be added in proportions falling within the range of 0.01 to 30 parts by weight per 100 parts by weight of the binder. These surface active agents are used as the antistatic agents. The surface active agents may also be used for purposes other than as the antistatic agents, for example, for dispersion, for improvement of lubricating properties, as coating assisting auxiliaries, as wetting agents, as hardening accelerators, and as dispersion accelerators.

In the abrasive member in accordance with the present invention, organic solvents may be used in any proportion during the dispersing, kneading, and coating processes for the abrasive grains, the binder, and the like. Examples of such organic solvents include ketones, such as acetone, methyl ethyl ketone, methyl isobutyl ketone, cyclohexanone, and isophorone; alcohols, such as methyl alcohol, ethyl alcohol, propyl alcohol, butyl alcohol, isobutyl alcohol, isopropyl alcohol, and methylcyclohexanol; esters, such as methyl acetate, ethyl acetate, butyl acetate, isobutyl acetate, isopropyl acetate, ethyl lactate, and glycol acetate monoethyl ether; ethers, such as diethyl ether, tetrahydrofuran, ethylene glycol dimethyl ether, ethylene glycol monoethyl ether, and dioxane; aromatic hydrocarbons, such as benzene, toluene, xylene, cresol, chlorobenzene, and styrene; chlorinated hydrocarbons, such as methylene chloride, ethylene chloride, carbon tetrachloride, chloroform, ethylene chlorohydrin, and dichlorobenzene; N,N-dimethylformamide, and hexane. Ordinarily, two or more of the above-enumerated organic solvents are used in combination in arbitrary proportions. The organic solvents may contain small amounts of impurities (e.g., polymerization products of the organic solvents, moisture, and raw material constituents of the organic solvents) in proportions of not larger than 1% by weight.

Ordinarily, the organic solvents are used in proportions falling within the range of 50 to 20,000 parts by weight per 100 parts by weight of the total solids of the coating composition for the abrasive layer. The solid contents in the coating composition for the abrasive layer should preferably fall within the range of 5% by weight to 60% by weight. Water, or the like, may be employed in lieu of the organic solvents.

When each abrasive layer is to be formed, the constituents described above are selected appropriately and dispersed or dissolved in the organic solvents, and a coating composition is thereby prepared. The coating composition is applied onto the substrate and dried. In cases where the substrate takes on the form of a disk or a card, the thickness of the substrate may fall within the range of approximately 0.03 mm to approximately 10 mm. Examples of the materials for the substrate include polyesters, such as a polyethylene terephthalate and a polyethylene naphthalate; polyolefins, such as a polypropylene; cellulose derivatives, such as cellulose triacetate and cellulose diacetate; vinyl resins, such as a polyvinyl chloride; plastic materials, such as a polycarbonate, a polyimide, a polyamide, and a polysulfone; metals, such as aluminum and copper; and ceramic materials, such as glass. Before the coating composition is applied onto the substrate, the substrate may be subjected to corona discharge treatment, plasma treatment, primecoating treatment, heat treatment, dust-resistant treatment, metal vapor evaporation treatment, and/or alkali treatment.

The substrates are described in, for example, West Germany Patent No. 3338854A specification, Japanese Unexamined Patent Publication Nos. 59(1984)-116926 and 61(1986)-129731, U.S. Pat. No. 4,388,368, and "Fiber and Industry," by Yukio Mitsuishi, Vol. 31, pp. 50–55, 1975. As for an abrasive tape, or the like, the surface roughness, expressed in terms of arithmetic mean deviation (Ra), of the substrate should preferably fall within the range of 0.001 μm to 5.0 μm. In accordance with the characteristics, which the substrate is required to have, the Young's modulus (F5 value) in each of the longitudinal direction and the width direction of the substrate may fall within the range of 2 $kg/mm^2$ to 30 $kg/mm^2$ (1 $kg/m^2$=9.8 Pa).

No limitation is imposed on how the dispersing and kneading processes are carried out. The order, in which the constituents (the resins, the grains, the lubricants, the solvents, and the like) are added, the timing, with which the constituents are added during the dispersion and kneading processes, the temperature at which the dispersion process is carried out (and which will ordinarily fall within the range of 0° C. to 80° C.), and the like, may be selected appropriately. One of various types of kneading machines may be used in order to prepare the coating composition for each abrasive layer. For example, it is possible to use a twin roll mill, a triple roll mill, a ball mill, a pebble mill, a trommel, a sand grinder, a Szegvari attritor, a high-speed impeller dispersing machine, a high-speed stone mill, a high-speed impact mill, a disperser, a kneader, a high-speed mixer, a ribbon blender, a Ko-kneader, an intensive mixer, a tumbler, a blender, a homogenizer, a single-screw extruder, a twin-screw extruder, or an ultrasonic dispersing machine. Ordinarily, a plurality of the dispersing and kneading machines are used, and the dispersing and kneading processes are carried out continuously. Details of the dispersing and kneading techniques are described in, for example, "Paint Flow and Pigment Dispersion," by T. C. Patton, John Wiley & Sons, 1964; "Industrial Materials," by Shin-ichi Tanaka, Vol. 25, p. 37, 1977; and literature cited in these publications. As auxiliary means for the dispersing and kneading techniques, steel balls, steel beads, ceramic beads, glass beads, and organic polymer beads, which have sizes equivalent to sphere diameters of 0.05 mm to 10 cm, may be used in order to carry out the dispersing and kneading processes efficiently. The shapes of these materials are not limited to spheres. These materials are described in, for example, U.S. Pat. Nos. 2,581,414 and 2,855,156. In the present invention, the coating composition for the abrasive layer may be prepared by carrying out the dispersing and kneading processes in accordance with the methods described in the aforesaid publications, the literature cited therein, and the like.

When the coating composition for the abrasive layer is to be applied onto the substrate, the viscosity of each coating composition may be adjusted at a value falling within the range of 1 to 20,000 centistrokes at 25° C. The coating composition may be applied onto the substrate by using any of coating apparatuses, for example, an air doctor coater, a blade coater, an air-knife coater, a squeeze coater, an impregnation coater, a reverse-roll coater, a transfer roll coater, a gravure coater, a kiss-roll coater, a cast coater, a spray coater, a rod coater, a forward-rotation roll coater, a curtain coater, an extrusion coater, a bar coater, or a lip coater. The other coating methods may also be used. The coating methods are described in, for example, "Coating Engineering," published by Asakura Shoten, pp. 253–277, Mar. 20, 1971. The order, in which the coating compositions are applied, may be selected arbitrarily. Before the desired coating composition is applied to the substrate, a prime-coating layer may be applied, or corona discharge treatment, or the like, may be carried out in order to enhance the adhesion to the substrate. For the formation of a plurality of abrasive layers, simultaneous multi-layer coating, successive multi-layer coating, or the like, may be carried out. Such coating methods are described in, for example, Japanese Unexamined Patent Publication Nos. 57(1982)-123532, 59(1984)-142741, and 59(1984)-165239, and Japanese Patent Publication No. 62(1987)-37451.

With the methods described above, the coating composition for the top abrasive layer or the lower abrasive layer is applied to a thickness of, for example, approximately 1 μm to approximately 200 μm on the substrate. The applied coating composition is then immediately dried in a plurality of steps at temperatures of 20° C. to 130° C., and thereafter the formed abrasive layer is dried to a thickness of 1 μm to 100 μm. At this time, ordinarily, conveyance of the substrate is carried out at a conveyance speed of 10 m/minute to 900 m/minute, the drying temperatures in a plurality of drying zones are adjusted at 20° C. to 130° C., and the amount of the solvent remaining in the coating film is set at 0.1 $mg/m^2$ to 40 $mg/m^2$. When necessary, a surface smoothing process may then be carried out, and the abrasive member web may then be cut into a desired shape. The abrasive member in accordance with the present invention is thereby produced. In this case, pre-treatment and surface treatment of powder, kneading and dispersing, coating, drying, smoothing, heat treatment, EB treatment, surface abrading, cutting, and winding processes should preferably carried out continuously. Such techniques are described in, for example, Japanese Patent Publication Nos. 39(1964)-28368, 40(1965)-23625, 47(1972)-38802, 48(1973)-11336, and 52(1977)-17404, Japanese Unexamined Patent Publication Nos. 49(1974)-53631, 50(1975)-112005, 51(1976)-77303, 60(1985)-70532, and 2(1990)-265672, U.S. Pat. Nos. 3,473,960, 4,728,569, and 4,746,542, and British Patent No. 1,191,424. Also, the method described in Japanese Patent Publication No. 41(1966)-13181 is considered as being a basic and important technique in this field.

After the thus formed abrasive member is cut, the abrasive member is wound up around a desired plastic or metal reel. Immediately before the abrasive member is wound up around the reel or in the process prior to the wind-up process, the abrasive member should preferably be burnished and/or cleaned. Specifically, with the burnishing process, protrusions on the surface of the abrasive member are scraped out, and the surface of the abrasive member is thereby made smooth by using a hard material, such as a sapphire blade, a shaving blade, a hard material blade, a diamond blade, or a ceramic blade. No limitation is imposed on the hardness of the material used for the burnishing process, and any of materials, which can remove protrusions on the surface of the abrasive member, may be employed. However, the Mohs hardness of the material used for the burnishing process should preferably be 8 or higher. The materials need not necessarily take on the form of blades and may have other shapes, such as square, round, and wheel shapes. (The material may be provided on the circumferential surface of a rotatable cylinder.)

The cleaning process is carried out in order to remove foreign substances, excessive lubricating agents, and the like, from the surface of the abrasive member. For this purpose, the surface layers of the abrasive member are wiped with a nonwoven fabric, or the like. As the wiping materials, it is possible to use, for example, various Vilene products supplied by Japan Vilene Co., Ltd., Toraysee and Ecsaine supplied by Toray Industries, Inc., a material available as Kimwipe (trade name), various abrasive tapes supplied by Fuji Photo Film Co., Ltd., a nylon nonwoven fabric, a polyester nonwoven fabric, a rayon nonwoven fabric, an acrylonitrile nonwoven fabric, a mixed nonwoven fabric, and tissue paper. Such materials are also described in, for example, Japanese Patent Publication Nos. 46(1971)-39309, 58(1983)-46767, and 58(1983)-46768, and Japanese Unexamined Patent Publication Nos. 56(1981)-90429, 63(1988)-259830, and 1(1989)-201824.

As for the abrasive grains, the binders, the additives (such as lubricating agents, dispersing agents, antistatic agents, surface treatment agents, carbon black, abrasive grains, light blocking agents, antioxidants, and mildew-proofing agents), the solvents, and/or substrates (which may be provided with a prime-coating layer, a backing layer, and a back prime-coating layer), which may be utilized for the abrasive member in accordance with the present invention, and how to prepare these constituents, reference may be made to, for example, the method for making an abrasive tape, which is disclosed in Japanese Patent Publication No. 56(1981)-26890.

EXAMPLES

The present invention will further be illustrated by the following nonlimitative examples. In these examples, the term "parts" means parts by weight.

Examples 1, 2, and 3

A prime-coating layer was applied onto a substrate constituted of a polyester film having a thickness of 75 μm. A first coating composition for an abrasive layer was applied onto the prime-coating layer and dried. In this manner, a lower abrasive layer having a thickness of 50 μm was formed on the prime-coating layer.

A second coating composition for an abrasive layer was applied with a bar coating process onto the lower abrasive layer such that the dry thickness of the abrasive layer might be 3 μm. The coating composition was then dried. In this manner, a top abrasive layer was formed on the lower abrasive layer, and a sample of an abrasive member (abrasive tape) was prepared.

In the respective examples, the grain diameter of the abrasive grains X contained in the lower abrasive layer was varied. As the abrasive grains X, alumina grains were used. The mean grain size of the abrasive grains X was set to be 20 μm in Example 1, 30 μm in Example 2, and 50 μm in Example 3. Also, in the respective examples, as the abrasive grains Y contained in the top abrasive layer, alumina grains having a mean grain size of 0.5 μm were used.

As for the obtained samples of the abrasive tapes, an abrasion test and measurement of the surface roughness, expressed in terms of arithmetic mean deviation Ra, of the abraded surface of the abraded material were carried out. The results shown in Table 1 were obtained. In the abrasion test, a steel ball was abraded by the abrasive tape with 20 reciprocal movements, the rate of wear of the steel ball was calculated, and the abrasion rate of the steel ball was indicated as a relative value. In the measurement of the surface roughness, the arithmetic mean deviation Ra (according to JIS-B-R0601-1982) of the abraded surface of the steel ball, which was used in the measurement of the rate of wear, was measured with a stylus type of surface texture measuring instrument (SURFCOM supplied by Tokyo Seimitsu Co., Ltd.).

Comparative Examples 1, 2, 3, and 4

The test results obtained in Comparative Examples 1, 2, 3, and 4 are also shown in table 1. In Comparative Examples 1, 2, 3, and 4, the prime-coating layer was coated onto the same kind of the substrate as that in Examples 1, 2, and 3. Also, the coating composition for the abrasive layer was applied onto the prime-coating layer in the same manner as that in Examples 1, 2, and 3, except that only the lower abrasive layer of Examples 1, 2, and 3 was formed on the prime-coating layer in Comparative Examples 1, 2, and 3, and except that only the top abrasive layer of Examples 1, 2, and 3 was formed on the prime-coating layer in Comparative Example 4.

| First coating composition: | |
|---|---|
| Abrasive grains X | 100 parts |
| Binder (vinyl chloride resin) | 3 parts |
| Binder (polyester polyurethane, content of sulfonic acid group: $3 \times 10^{-3}$ equivalents per g of the resin, content of epoxy group: $2 \times 10^{-5}$ equivalents per g of the resin) | 5 parts |
| Binder (polyisocyanate, a reaction product of 3 mols of tolylene diisocyanate with 1 mol of trimethylolpropane) | 2 parts |
| Dispersing agent (lecithin) | 1 part |
| Diluting agent (methyl ethyl ketone/cyclohexanone = 2/1) | 200 parts |
| Diluting agent (toluene/MIBK) | 150 parts |
| Additive (carbon black) | 1 part |
| **Second coating composition:** | |
| Abrasive grains Y | 100 parts |
| Binder (vinyl chloride resin) | 7 parts |
| Binder (polyester polyurethane, content of sulfonic acid group: $3 \times 10^{-3}$ equivalents per g of the resin) | 12 parts |
| Binder (polyisocyanate, a reaction product of 3 mols of tolylene diisocyanate with 1 mol of trimethylolpropane) | 5 parts |
| Dispersing agent (lecithin) | 1 part |
| Diluting agent (methyl ethyl ketone/cyclohexanone = 2/1) | 200 parts |
| Diluting agent (toluene/MIBK) | 150 parts |
| Additive (carbon black) | 1 part |

TABLE 1

| | X (grain dia.) | Y (grain dia.) | Abrasion rate (%) | Ra of abraded surface |
|---|---|---|---|---|
| Ex. 1 | Alumina 20 μm | Alumina 0.5 μm | 90 | 0.01 μm |
| Ex. 2 | Alumina 30 μm | Alumina 0.5 μm | 100 | 0.01 μm |
| Ex. 3 | Alumina 50 μm | Alumina 0.5 μm | 150 | 0.01 μm |
| Comp.Ex. 1 | Alumina 20 μm | None | 100 | 2 μm |
| Comp.Ex. 2 | Alumina 30 μm | None | 120 | 3 μm |
| Comp.Ex. 3 | Alumina 50 μm | None | 200 | 5 μm |
| Comp.Ex. 4 | None | Alumina 0.5 μm | 1 | 0.01 μm |

As is clear from the results shown in Table 1, with the abrasive tapes of Examples 1, 2 and 3 in accordance with the present invention, though the grain diameter of the abrasive grains contained in the top abrasive layer is small, an abrasive power can be obtained which is as high as the abrasive power obtained with the abrasive tapes of Comparative Examples 1, 2, and 3 provided with the abrasive layer containing the abrasive grains having a large grain diameter. Also, with the abrasive tapes of Examples 1, 2 and 3 in accordance with the present invention, an abraded material having an abraded surface can be obtained which has a high surface smoothness and little scratch as in the material having been abraded with the abrasive tape of Comparative Example 4 provided with the abrasive layer containing the abrasive grains having a small grain diameter. On the other hand, with the abrasive tapes of Comparative Examples 1, 2, and 3, though a high abrasive power can be obtained, large scratches occur on the abraded surface of the abraded material. With the abrasive tape of Comparative Example 4, though good surface smoothness of the abraded material can be obtained, the abrasive power is markedly low.

Examples 4, 5, 6, 7, and 8

In Examples 4 through 8, in the same manner as that in Examples 1, 2, and 3, a prime-coating layer was applied onto a substrate constituted of a polyester film having a thickness of 75 μm, and a lower abrasive layer having a thickness of 50 μm was formed on the prime-coating layer by the application of the first coating composition for the abrasive layer. Thereafter, a top abrasive layer having a thickness of 3 μm was formed on the lower abrasive layer by the application of the second coating composition for the abrasive layer. In the respective examples, as the abrasive grains X contained in the lower abrasive layer, alumina grains having a mean grain size of 30 μm were used. Also, the grain diameter of the abrasive grains Y contained in the top abrasive layer was varied. As the abrasive grains Y, white alumina grains were used. The mean grain size of the abrasive grains Y was set to be 4 μm in Example 4, 7 μm in Example 5, 8 μm in Example 6, 11 μm in Example 7, and 14 μm in Example 8.

As for the obtained samples of the abrasive tapes, measurement of the surface roughness Ra of each abrasive tape, an abrasion test, and measurement of the state of abrasion scratches were carried out. The results shown in Table 2 were obtained. The abrasion test was carried out in the same manner as that in Examples 1, 2, and 3. In the measurement of the state of abrasion scratches, the abraded surface of the abraded material was observed with a microscope, and the degree of occurrence of the abrasion scratches was rated.

Comparative Examples 5 through 11

The test results obtained in Comparative Examples 5 through 11 are also shown in table 2.

TABLE 2

| | X (grain dia.) | Y (grain dia.) | Ra of tape | Abrasion rate | Abrasion scratches |
|---|---|---|---|---|---|
| Ex. 4 | Alumina 30 μm | WA3000 4 μm (13%) | 1.7 μm | 100% | ○ |
| Ex. 5 | Alumina 30 μm | WA2000 7 μm (23%) | 2.3 | 110% | ○ |
| Ex. 6 | Alumina 30 μm | WA1500 8 μm (26%) | 2.5 | 110% | ○ |
| Ex. 7 | Alumina 30 μm | WA1000 11 μm (36%) | 3.5 | 120% | ○ |
| Ex. 8 | Alumina 30 μm | WA 800 14 μm (47%) | 4.0 | 130% | ○ |
| Comp.Ex. 5 | None | WA3000 4 μm | 0.5 | 30% | ○ |
| Comp.Ex. 6 | None | WA2000 7 μm | 0.8 | 40% | ○ |
| Comp.Ex. 7 | None | WA1500 8 μm | 1.0 | 50% | ○ |
| Comp.Ex. 8 | None | WA1000 11 μm | 2.0 | 70% | ○ |
| Comp.Ex. 9 | None | WA 800 14 μm | 2.3 | 90% | ○ |
| Comp.Ex. 10 | None | WA 700 18 μm | 3.5 | 130% | ○ |
| Comp.Ex. 11 | Alumina 30 μm | WA 700 18 μm (60%) | 7.0 | 150% | X |

As is clear from the results shown in Table 2, with the abrasive tapes of Examples 4 through 8 in accordance with the present invention, in which the lower abrasive layer contains the abrasive grains having a large grain diameter, a high abrasive power can basically be obtained. Also, as the mean grain size of the abrasive grains contained in the top abrasive layer varies from 4 μm to 7 μm, 8 μm, 11 μm, and 14 μm, the value of the surface roughness Ra of the abrasive tape increases from 1.7 μm up to 4.0 μm, and the abrasive power also becomes high. Further, large abrasion scratches do not occur, and abraded surfaces having good condition can be obtained. However, in cases where the grain size of the abrasive grains contained in the top abrasive layer becomes as large as 18 μm as in Comparative Example 11, though the abrasive power becomes high, the extent of occurrence of abrasion scratches becomes high. With the abrasive tapes of Comparative Examples 5 through 10, which are not provided with the lower abrasive layer, though their top abrasive layers contain the abrasive grains having the same grain diameters as those in Examples 4 through 8, the value of the surface roughness Ra of the abrasive tapes do not become large as in Examples 4 through 8, and a high abrasive power cannot be obtained.

What is claimed is:

1. An abrasive member comprising a non-magnetic substrate and a plurality of abrasive layers which are overlaid upon the non-magnetic substrate, each of the abrasive layers mainly containing a binder and hard abrasive grains which have a Mohs hardness of at least 6 and are dispersed in the binder, wherein the plurality of the abrasive layers include a top abrasive layer and a lower abrasive layer which is formed between the non-magnetic substrate and the top abrasive layer, wherein the thickness of the top abrasive layer is at most A/2 where A represents the thickness of the lower abrasive layer, and the mean grain diameter of the abrasive grains contained in the top abrasive layer is at most B/2, where B represents the mean grain diameter of the abrasive grains contained in the lower abrasive layer.

2. An abrasive member as defined in claim 1 wherein the thickness A of the lower abrasive layer falls within the range of 10 μm to 100 μm and the mean grain diameter B of the abrasive grains contained in the lower abrasive layer falls within the range of 5 μm to 100 μm.

3. An abrasive member as defined in claim 1 wherein the abrasive grains contained in the top abrasive layer are selected from the group consisting of alumina, chromium oxide, silicon carbide, diamond, and combinations thereof.

4. An abrasive member as defined in claim 1 wherein the abrasive grains contained in the lower abrasive layer are alumina.

* * * * *